US009803441B2

(12) United States Patent
West

(10) Patent No.: US 9,803,441 B2
(45) Date of Patent: Oct. 31, 2017

(54) SEATED HAMMER APPARATUS FOR CORE SAMPLING

(71) Applicant: Flexidrill Limited, Auckland (NZ)

(72) Inventor: Gregory Donald West, Wanaka (NZ)

(73) Assignee: FLEXIDRILL LIMITED, Auckland (NZ)

( * ) Notice: Subject to any disclaimer, the term of this patent is extended or adjusted under 35 U.S.C. 154(b) by 318 days.

(21) Appl. No.: 14/438,743

(22) PCT Filed: Nov. 8, 2013

(86) PCT No.: PCT/IB2013/059987

§ 371 (c)(1),
(2) Date: Apr. 27, 2015

(87) PCT Pub. No.: WO2014/072938

PCT Pub. Date: May 15, 2014

(65) Prior Publication Data

US 2015/0300117 A1 Oct. 22, 2015

Related U.S. Application Data

(60) Provisional application No. 61/724,007, filed on Nov. 8, 2012.

(51) Int. Cl.
*E21B 10/02* (2006.01)
*E21B 25/10* (2006.01)
(Continued)

(52) U.S. Cl.
CPC ..... *E21B 25/10* (2013.01); *E21B 1/00* (2013.01); *E21B 6/00* (2013.01); *E21B 6/04* (2013.01);
(Continued)

(58) Field of Classification Search
CPC ..... E21B 25/10; E21B 25/02; E21B 10/02; E21B 25/00; E21B 1/00; E21B 6/00–6/08
(Continued)

(56) References Cited

U.S. PATENT DOCUMENTS 1,896,106 A * 2/1933 Simmons ..... E21B 4/14 173/206
2,857,138 A * 10/1958 Svendsen ..... E21B 25/02 173/151

(Continued)

FOREIGN PATENT DOCUMENTS

DE 3200927 A1 7/1983

*Primary Examiner* — Kenneth L Thompson
*Assistant Examiner* — Steven MacDonald
(74) *Attorney, Agent, or Firm* — Jacobson Holman, PLLC.

(57) ABSTRACT

A retrievable core sampling assembly for latching to or relative to a rotatable tubular housing of a core sampling apparatus to allow the capture and retrieval of a core from a subterranean formation, the assembly comprising or including: a core catcher barrel for a core, the barrel being rotationally isolated from the tubular housing and cooperable with a core taking bit coupled to the rotatable tubular housing to retain a core, and a hammer for providing impact to the core taking bit along a longitudinal impact path that is or is substantially decoupled from the core catcher barrel so that when latched, rotation and impact of the core taking bit captures and passes core material from the formation to the core catcher barrel in manner that isolates a core in the core catcher barrel from rotation and impact forces.

10 Claims, 5 Drawing Sheets

(51) Int. Cl.

| | |
|---|---|
| ***E21B 25/00*** | (2006.01) |
| ***E21B 6/00*** | (2006.01) |
| ***E21B 1/00*** | (2006.01) |
| ***E21B 25/02*** | (2006.01) |
| ***E21B 6/04*** | (2006.01) |

(52) U.S. Cl.
CPC ..... *E21B 10/02* (2013.01); *E21B 25/00* (2013.01); *E21B 25/02* (2013.01)

(58) Field of Classification Search
USPC ..... 175/57, 244, 255, 293–306, 405
See application file for complete search history.

(56) References Cited

U.S. PATENT DOCUMENTS

| | | | | | |
|---|---|---|---|---|---|
| 3,524,511 | A | * | 8/1970 | Klemm | E21B 4/14 173/78 |
| 3,854,539 | A | * | 12/1974 | Sweeney | E21B 4/06 173/73 |
| 3,903,975 | A | * | 9/1975 | Sweeney | E21B 4/06 175/246 |
| 3,933,209 | A | * | 1/1976 | Sweeney | E21B 4/06 173/80 |
| 3,977,482 | A | * | 8/1976 | Reed | E21B 25/02 175/246 |
| 4,279,315 | A | | 7/1981 | Tibussek | |
| 4,598,777 | A | | 7/1986 | Park et al. | |
| 5,494,119 | A | | 2/1996 | Tully | |
| 5,601,152 | A | * | 2/1997 | Harrison | E21B 7/24 175/246 |

* cited by examiner

SEATED HAMMER APPARATUS FOR CORE SAMPLING

The present invention relates to core sampling of ground formations in general. The invention is also for a novel core sampling impact apparatus and related apparatus, systems, and methods and uses.

Within the drilling industry and more specifically core sampling within the mineral exploration industry there is a need to continually lower the cost of exploration; this is normally achieved by making the process faster, and or the machinery simpler or cheaper. This application achieves these objectives.

Existing Methodology

Typically core drilling is carried out using sophisticated drill rigs which rotate thin walled drill rods (casing) at high speeds (often >1,000 rpm) with a diamond impregnated (or other) core bit attached to the lower end of the drill rod (casing).

As the bit is rotated it advances into the formation and the resulting rock "core" advances inside the drill rods (casing) and into a core barrel. The core barrel is usually 1.5-3 meters long. Once the core barrel is full (measured by the length the drill rod has advanced from surface) a latching tool is lowered on a wire line from surface inside the drill rods (casing). The latching tool attaches to the core barrel and as it is pulled from the inside of the drill rods (casing) the lower end of the core barrel snags hold of the rock core breaking it from the rock formation and the entire assembly is pulled to surface for core recovery. The drill rods (casing) stay in the ground forming a temporary casing which prevents the bore hole from collapsing.

The core barrel etc., is then lowered back down inside the drill rods (casing) and the process continues until the required depth of core has been recovered. While this system works well it is expensive and relatively slow. In addition the diamond impregnated core bits, which work by abrading the rock are expensive, relatively fragile and are often damaged if too much weight is applied (pushed too hard) or if there is a change in the formation being drilled.

Tibussek U.S. Pat. No. 4,279,315 describes a wire line retrievable core sampling device which uses a rotating cam arrangement to apply low frequency—low force impact to a non-rotating core sampling barrel. This mechanism by its very nature precludes its ability to drill (rotate and therefore penetrate) hard rock when core sampling. Additionally this cam impacting arrangement is not able to generate the considerable forces required for crushing and therefore penetrating hard formations.

While the core sampling barrel is rotationally static in this device—there is no mechanism to protect the core from the up and down axial movement that the core sampling barrel uses to advance into the formation.

Sweeny U.S. Pat. No. 3,854,539 describes a wire line retrievable hammer which unlike Tibussek uses pressurised drilling fluid to energise a piston which transfers energy to a core sampling bit. However in practise this mechanism is flawed as there is no method for securely locking the hammer to the outer casing which therefore stops the tool from delivering sufficient impact force to the bit and therefore the rock. Instead the hammer bounces within the outer housing as the hammer blows are delivered.

They try to solve this problem by using the hydraulic pressure above the hammer to hold the hammer in place, but as the hammer has porting through to the bit this will not work. This impact force is further diminished as the anvil and core sampling tube impact directly to the drill bit, as the drill bit is not able to move axially relative to the outer casing with each impact. This means that each impact from the hammer is trying to stretch the outer casing, not only diminishing the energy available to crush rock, but also placing considerable stress on the outer casing rods, which limits its working life.

Again as with the Tibussek art, the core sample is not protected from the axial impact movement of the coring hammer—which testing has shown to damage or destroy otherwise valuable core samples.

SUMMARY OF INVENTION

Applicants propose and their analysis has shown that a small diameter hammer of any type such as air, fluid, magnetic, electromagnetic, or a mud motor (PDM) oscillator can be lowered inside the drill rods (casing) and seated inside the assembly so that when activated the hammer impacts upon a core bit and allows for faster core sampling and/or protects the core sample itself.

It is an object of the present invention in its various aspects to provide a core sampling apparatus and/or assembly, and optionally related apparatus, systems, methods and uses that will satisfy one, more and preferably most or all of such capabilities and/or those listed below.

A core sampling assembly/apparatus would have one or more (most preferably all) of the following capabilities:

- be able to be used on any (core sampling) drill rig, not just drills with high rotary speeds,
- be able to advance rapidly into the formation,
- take quality core samples (cores with mechanical damage from rotation, impact or fluid erosion are not desirable),
- be able as a system to be compatible with a variety of fluid additives—to minimise friction, remove cuttings etc,
- be able to be wire line retrievable, so that when the core sample is pulled to surface for core recovery, the outer drill rods or casing stay in the ground to seal the bore and stop the hole collapsing, and
- be able to drill and core through any formation.

Embodiments can use conventional impact type bits with carbide or diamond impact bits (or similar) but with the centre removed to leave a rock core intact. These bits are very durable, are not easily damaged by a change in formation or by excessive weight on bit—and in addition they only require slow rotation (typically less than 100 RPM) meaning that specialised high speed diamond core rigs are not required.

In an aspect the invention is a core sampling apparatus to allow the capture and retrieval of a core from a subterranean formation, the apparatus comprising or including: a rotatable tubular housing, a core taking bit constrained to rotate with the housing yet able to move axially with respect to the rotatable tubular housing, a retrievable core sampling assembly latchable to or relative to the rotatably tubular housing comprising: a core catcher barrel for a core, the barrel being rotationally isolated from the tubular housing and cooperable with the core taking bit to retain a core, and a hammer for providing impact to the core taking bit along a longitudinal impact path that is or is substantially decoupled from the core catcher barrel, wherein the tubular housing is operable to rotate the bit and the hammer is operable to impact the bit to capture and pass core material from the formation to the core catcher barrel in manner that isolates a core in the core catcher barrel from rotation and impact forces.

Preferably the longitudinal impact path comprises an impact tube or structure surrounding the core catcher barrel that receives impact from the hammer at a first end and bears against the core taking bit at another end to transfer the impact.

Preferably the core taking bit is splined to the rotatable tubular housing to rotationally constrain the core taking bit yet enable it to move axially, and upon receiving an impact, the core taking bit moves axially with respect to the rotatable tubular housing.

Preferably the retrievable core sampling assembly is latchable to or relative to the rotatable tubular housing using a latching assembly that latches the assembly to or relative to the rotatably tubular housing.

Preferably a compliant member is provided between the latching assembly and the hammer to hold the hammer directly or indirectly on the bit, yet during hammer operation restrict stress on the latching assembly to maintain latching of the assembly to or relative to the rotatable tubular housing.

Preferably the hammer is actuated by drilling fluid, wherein the drilling fluid exhausts between the core catcher barrel and impact tube or structure that surrounds the core catcher barrel and through the core taking bit thus bypassing a core in the core catcher barrel.

Preferably the hammer comprises a rotor that upon rotation generates longitudinal movement in an impact member that provides the impact to the core taking bit, wherein the rotor is coupled via a swivel joint to the core catcher barrel so that the barrel can be retracted yet is rotationally decoupled from the rotor to isolate a core in the catcher barrel from rotation forces.

Preferably the hammer is a magnetic hammer, and the rotor is an inner magnetic array that rotates relative to an outer magnetic array that is the impact member, wherein the inner magnetic array is coupled via the swivel joint to the core catcher barrel so that the barrel can be retracted yet is rotationally decoupled from the rotor to isolate a core in the catcher barrel from rotation forces.

Preferably the latching assembly, compliant member, hammer, and core catcher barrel of the core sampling assembly are coupled so that they can be inserted into the rotatable tubular housing and latched to or relative to the rotatable tubular housing and retrieved from the rotatable tubular housing by delatching the latching assembly and removing the core sampling assembly using a wire latch.

In another aspect the invention is a retrievable core sampling assembly for latching to or relative to a rotatable tubular housing of a core sampling apparatus to allow the capture and retrieval of a core from a subterranean formation, the assembly comprising or including: a core catcher barrel for a core, the barrel being rotationally isolated from the tubular housing and cooperable with a core taking bit coupled to the rotatable tubular housing to retain a core, and a hammer for providing impact to the core taking bit along a longitudinal impact path that is or is substantially decoupled from the core catcher barrel, so that when latched, rotation and impact of the core taking bit captures and passes core material from the formation to the core catcher barrel in manner that isolates a core in the core catcher barrel from rotation and impact forces.

In another aspect the invention is a method of obtaining a core sample comprising using an apparatus/assembly of any preceding paragraph and operating the apparatus/assembly to rotate and hammer a bit in a manner to isolate the core from rotation and impact forces.

In another aspect the invention is a method of obtaining a core sample comprising using an apparatus/assembly of any preceding claim and operating the apparatus/assembly to rotate and hammer a bit in a manner to isolate the core from rotation and impact forces Described herein is a core sampling apparatus to allow the capture and retrieval of a core from a subterranean formation, the apparatus comprising or including (1) a rotatable tubular housing and a core taking impact bit constrained to rotate with the housing yet able to move axially with respect to the housing, (2) a retrievable assembly able (a) to be insertable into the housing so as to be latch retainable by, or relative to, the housing at a latching zone to prevent movement of the whole retrievable assembly while it impacts the bit and (b) when desired, of being delatched at the latching zone and withdrawn as a whole retrievable assembly from the housing;

wherein the latching zone is provided with a latch retention, wherein the retrievable assembly has a core catcher linked to a hammer mass of a hammer arrangement, or linked to a hammer arrangement having a hammer mass, whereby the core catcher is withdrawable as the hammer mass and/or hammer arrangement is withdrawn;

and wherein when the retrievable assembly is inserted as in (2)(a) the core catcher, without rotating, or without rotating synchronously, with the housing and impact bit, can receive and retain a core progressively being defined from the formation by the rotating and impacted bit, the hammer mass cycling between conditions of (A) advance towards or to the impact bit to provide an impact indirectly (e.g. via some interposed member or assembly) or directly upon the bit, and (B) retreat from the impact bit towards the latching zone into a spring or other compliant mechanism reducing shock loading upon the latch retention in the latching zone.

Described herein is a core sampling apparatus to allow the capture and retrieval of a core from a subterranean formation, the apparatus comprising or including (1) a rotatable tubular housing and a core taking impact bit constrained to rotate with the housing yet able to move axially with respect to the housing, (2) a retrievable assembly able (a) to be insertable into the housing so as to be latch retainable by, or relative to, the housing at a latching zone against movement as the whole retrievable assembly away from the impact bit and (b) when desired, of being delatched at the latching zone and withdrawn as a whole retrievable assembly from the housing;

wherein the retrievable assembly has a core catcher linked to a hammer mass of a hammer arrangement, or linked to a hammer arrangement having a hammer mass, whereby the core catcher is withdrawable as the hammer mass and/or hammer arrangement is withdrawn;

and wherein when inserted as in (a) the core catcher, without rotating, or without rotating synchronously, with the housing and impact bit, can receive and retain a core progressively being defined from the formation by the rotating and impacted bit, the hammer mass cycling between conditions of (A) advance towards or to the impact bit to provide an impact indirectly (e.g. via some interposed member or assembly) or directly upon the bit, and (B) retreat from the impact bit towards the latching zone into a spring or other compliant mechanism reducing shock loading upon the latch retention in the latching zone.

Preferably, the bit is splined to the housing.

Preferably, interposed between the retrievable assembly and the housing is at least one member to transfer the hammer impact to the bit.

Preferably, said at least one member is a tube.

Preferably, the tube is not withdrawable uphole with the retrievable assembly.

In one range of embodiments, the hammer arrangement is a magnetic hammer arrangement.

Preferably, the magnetic hammer arrangement has a hammer mass to rotate with the housing and carrying an outer array of magnets and an inner assembly carrying an inner array of magnets able to be fluid driven to rotate relative to the hammer mass and housing.

Preferably, the inner assembly is swivel connected to said core catcher.

Preferably, a PDM empowers the magnetic hammer arrangement.

In another range of embodiments, the hammer arrangement is other than a magnetic hammer arrangement.

Preferably, the hammer arrangement is empowered (e.g. as if a piston) by a fluid or gas downflow.

Preferably, the hammer arrangement exhausts fluid from one or more outlets. Between the outer housing and the core catcher so as to not damage the core sample and the fluid exits into the bore hole via the core bit—to assist with drill cutting evacuation etc.

Preferably, the hammer arrangement is swivel connected to said core catcher, to help minimise any rotational damage from being imparted to the core sample.

Preferably, the hammer arrangement is not required to rotate with the housing.

Described herein is a downhole apparatus comprising or including a core taking impact bit, a casing of or for attachment into a drillstring with which the bit is captive to rotate but with respect to which it can move axially (e.g. preferably captive within axial relative movement limits), a tube or other impact transfer surround located coaxially of and within the casing able to move axially both with respect to the casing and with respect to the bit;

wherein the tube or surround is able to transfer hammer impacts to the bit.

Described herein is a withdrawable assembly comprising or including a core receiving barrel a downhole operable hammer, a spring or compliant system, a latching system to hold (relative to a drillstring casing) the assembly from a (significant) uphole movement until after delatching, and a retrieval attachment;

wherein the hammer is downhole operable with the spring or compliant system effective enough to reduce any momentary loading of the latching system to below any delatching or disengagement magnitude loading and with the downward hammering movement of the hammer (or its hammer mass) bypassing the core receiving barrel or to hammer a tube about the core receiving barrel.

Described herein is also, in combination, in use, or in assembly, both (A) downhole apparatus of the penultimate paragraph, and (B) a compatible withdrawable assembly of the preceding paragraph.

Described herein is the use in conjunction with a retrievable core catching and a rotatable drillstring casing within which the core catcher is located in use of both (i) a core taking bit to feed into the core catcher barrel, the bit to be impacted while rotating with the casing and reciprocating axially with respect to the casing, and (ii) a hammer removable with the core catcher and any captured core in its barrel, AND at least one of, and preferably both of, (iii) a hammer shock dissipating arrangement protecting against repeated momentary uphole shock loads, a downhole retention latching system between the hammer and the outer casing, and (iv) a hammer impact transmission member interposed between the casing and the core catcher, and preferably not carried by the core catcher, to hammer the core taking bit indirectly from the hammer, whereby the core bit is able to move axially with respect to the hammer and the outer housing.

Described herein a method of core extraction from a subterranean formation, the method involving rotating and impacting a core taking bit carried by a casing that rotates the bit, receiving the core as it is defined by the bit into the barrel of a core catcher, and retrieving the core within the catcher barrel when broken from the formation;

the method being characterised in that a hammer that directly or indirectly hammers the bit, but not the core catcher, is carried in assembly or association with the retrieval core catcher and the assembly or associated apparatus is latch retainable in the casing during such hammering yet a spring or compliant functionality is interposed between at least part of the hammer, or in its upward shock pathway, and part of the latch to reduce shock induced delatching.

Described herein is a core receiving and retrieving assembly for use or suitable for use downhole within a rotatable drillstring casing having a hammerable core taking bit captive to rotate with the casing yet move axially with respect thereto, the assembly comprising or including a retrievable hammer mechanism with a hammer mass, a core receiving barrel (preferably with a tripper), and a swivel connection between the hammer mechanism and the core receiving barrel, the arrangement being the hammer mass does not act through the core receiving barrel and the core receiving barrel need not rotate, nor move axially with any part of the hammer mechanism.

Described herein is an assembly insertable downhole into a drillstring casing having a core taking impact bit, the assembly comprising or including: a hammer mechanism, a core catcher associated with but not to be hammered by the hammer mechanism, and a hammer impact transfer tube upliftable with the hammer mechanism and core catcher yet axially movable with respect to the core catcher and able to be both endwise hammered and to endwise impact the impact bit in use.

Preferably the hammer mechanism is swivel connected to the core catcher.

Preferably there is a releasable latching system whereby the assembly can be held from upward movement during hammering.

Preferably it has a shock absorber or shock spreader to protect the latching system against uphole shock.

Preferably any use, combination, method, system or apparatus substantially as herein described with or without reference to any one or more of the accompanying drawings.

Described herein is any use, combination, method, system or apparatus substantially as herein described with or without reference to any one or more of the accompanying drawings.

Described herein are various embodiments of a wire line or the equivalent retrievable core sampling hammer system (the hammer mechanism can be of any type such as pneumatic or fluid driven, magnetic hammer, electromagnetic, or any other that imparts an impact directly or indirectly to the core sampling drill bit, which causes the core sampling bit to advance into the formation being sampled), but in its most preferred forms have the attributes discussed below.

(i) The core sampling drill bit is continually rotated while being impacted. This allows for rapid penetration in hard rock formations.

(ii) There is a mechanical mechanism which self-sets and seats the hammer inside the outer casing and which stops any up hole axial movement of the hammer during operation, thereby delivering maximum energy to the formation and therefore providing maximum speed of drilling. This locking mechanism is reversible to allow the hammer and core sample to be retrieved as required by a wire line system.

(iii) It is desirable to capture as large a diameter core as possible relative to the outer casing diameter. For this reason thin walled drill rods (casing) are used, meaning that the hammer locking mechanism only has a small cross sectional abutment area to lock against. With the substantial impact force the hammer needs to deliver to advance the core bit in hard formations, a means of minimising the up hole shock from the hammer through the (hammer locking) mechanism and into the thin abutment area is needed. This can be achieved by using a spring or other compliant mechanism above the hammer piston to help cushion the up hole shock that otherwise results as the hammer piston stops at the top of its piston stroke.

(iv) The drill bit is able to move axially relative to the outer casing with each blow from the hammer. This enables all of the impact energy to be delivered to the rock being drilled—without this feature each impact blow would be dampened by trying to stretch the outer casing (thus damaging associated drill rods/threads etc).

(v) The core sample (as it advances into the core barrel) is isolated from both the rotational force of the turning assembly and the axial forward and back impact from the impact transfer tube.

As used herein "spring" includes any resilient system able to prevent or at least reduce an uphole momentary shock loading of the withdrawable systems engagement at the latching zone. It may be of a single member or a plurality of members able, over a contacting zone, to spread in time and thus momentary magnitude the shock loading away through the latching system loads. The "spring" may couple to an energy absorption system (e.g. damper) or not [preferably not if the "spring" is sufficiently tuned to be in phase to the cycling of the associated hammer].

A spring may be one or more members of metal [e.g. a helical metal spring or a series of disc spring elements]. It can be of a non-metal [e.g. a suitable synthetic rubber]. It can be pneumatic.

Likewise "compliant", "compliant mechanism" and related terms can be used in respect of any alternative to a spring system.

The spring or compliant system preferably acts to buffer with or without damping.

As used herein "and/or" means "and" or "or", or where appropriate, both "and" and "or".

As used herein "gripper" or any other term referring to an arrangement to engage a core in the receiver and/or bit (the "tooling") can be of any suitable type. Preferably it is a self-deploying wedge based arrangement whether of a split ring or of individually captive sliding members.

As used herein "core catcher barrel", "core receiver" or "barrel" preferably incorporates a "gripper".

As used herein "formation", "formations", and "formation(s)" should be considered as interchangeable to render irrelevant any strata, consistency, or other change in any subterranean matrix (e.g. the ground, the seabed, a hill, etc).

As used herein reference to "magnetic", "magnetic arrays", "magnetic hammer" includes, but is not restricted to, those devices, apparatus, systems as in downhole hammers of the type disclosed in PCT/NZ2008/000217 (published as WO2009/028964) and PCT/IB2012/050875.

As used herein "downhole" in respect of any apparatus, system or the like does not exclude when any such apparatus is not actually downhole. The term refers to its intended purposes and/or when in situ for use at the bottom end of a drillstring.

As used herein "fluid" includes liquid(s), liquid systems [e.g. slurry, drilling mud etc], liquid/gas mixtures, gas or gas mixtures. Its use alongside any reference to pneumatics or gas is not restrictive of its scope.

BRIEF DESCRIPTION OF THE DRAWINGS

Preferred embodiments of the present invention will now be described with reference to.

DETAILED DESCRIPTION OF PREFERRED EMBODIMENTS

Figure 1A:
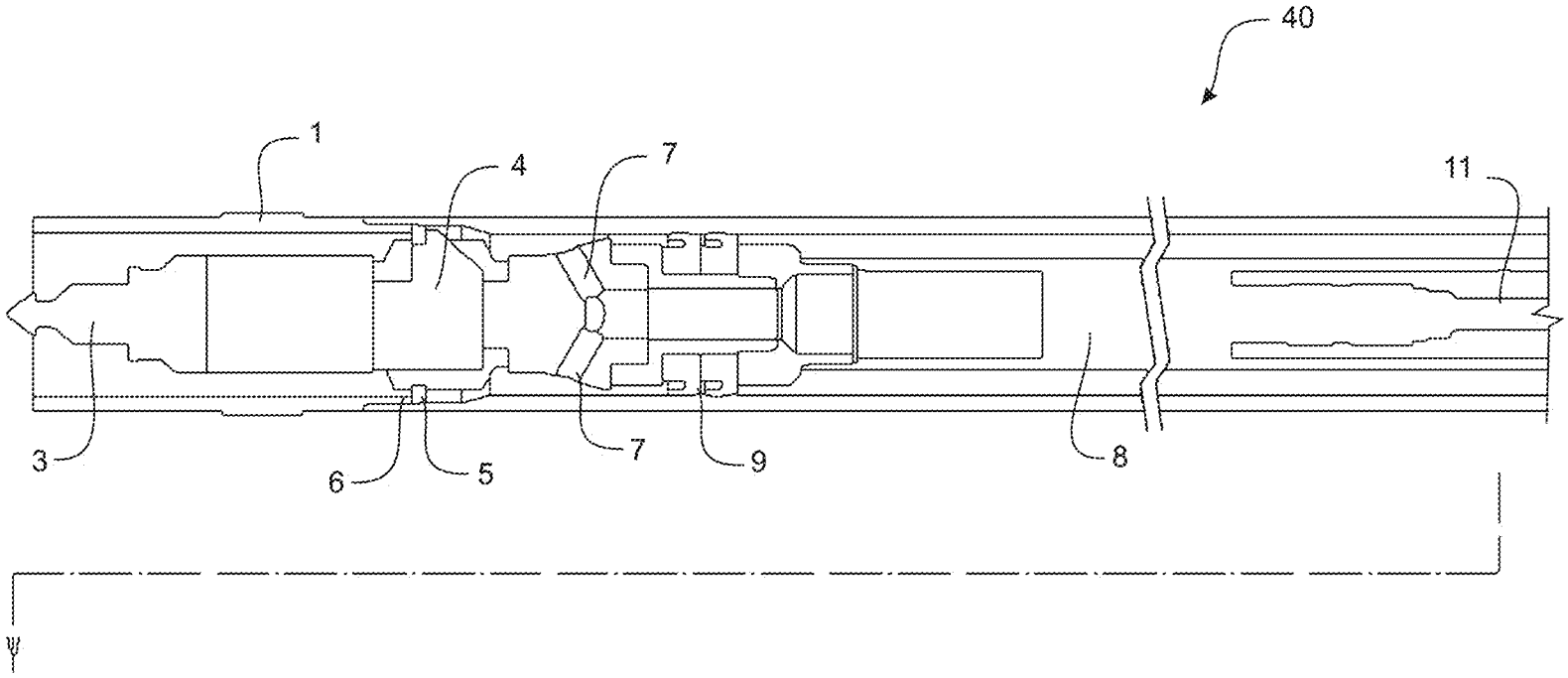
FIGS. 1A, 1B, 1C, 1D showing a magnetic hammer core sampling assembly/apparatus according to one embodiment.
Figure 1B:
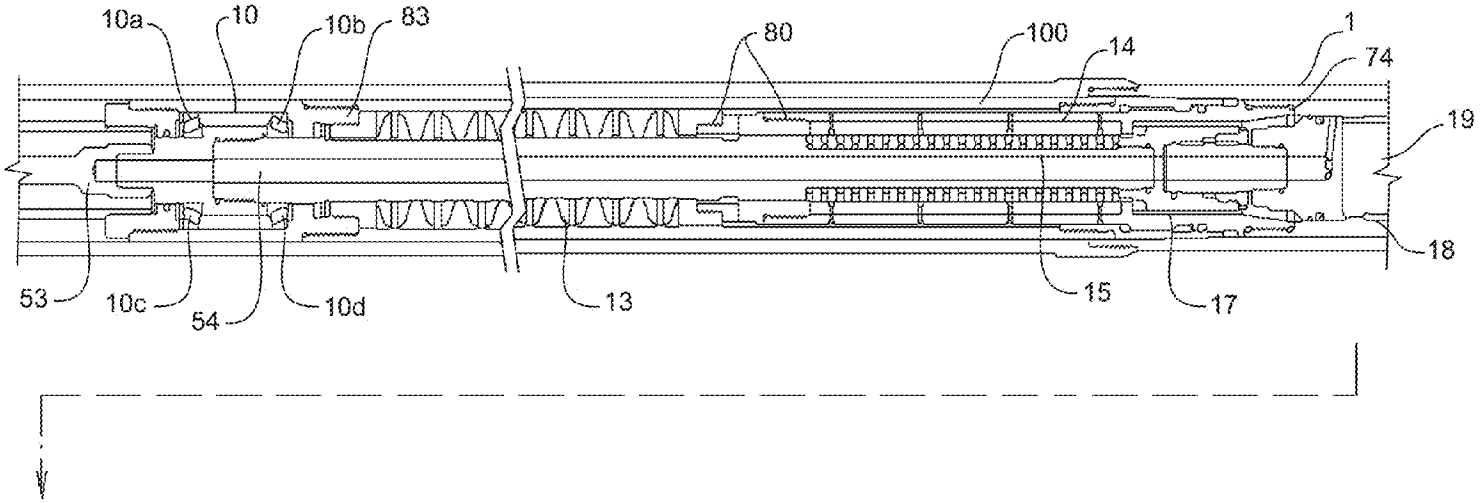
Figure 1C:
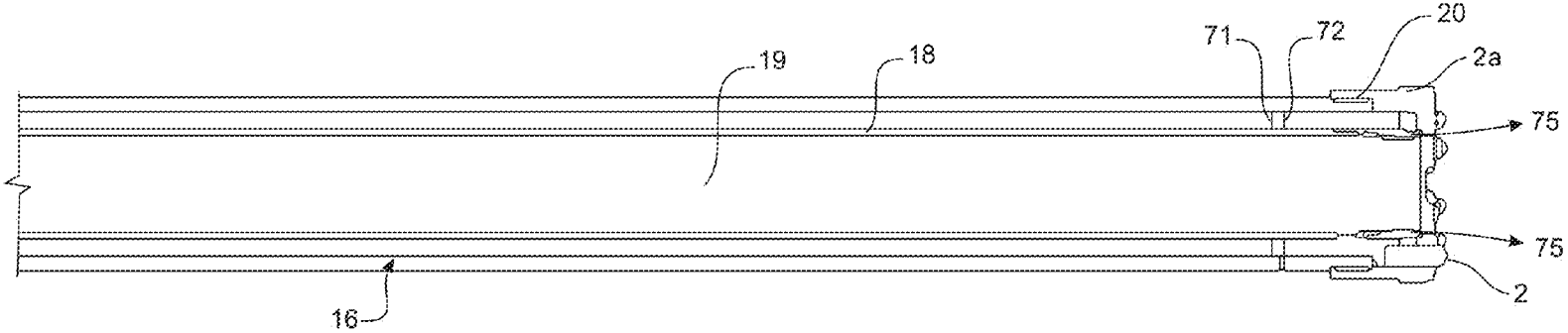

FIGS. 1A to 1C show a magnetic hammer core sampling apparatus/assembly according to one embodiment of the invention, incorporated or for incorporation into a drilling apparatus 40. The term "core sampling apparatus" can refer to an apparatus comprising or incorporated into a drilling apparatus for core sampling, or an apparatus separate to but for incorporation into a drilling apparatus to give the drilling apparatus core sampling capability—the term should be considered broadly to cover both options. In the present description, the term "core sampling assembly" is nominally used to refer to an apparatus for insertion/incorporation into a drilling apparatus, and the term "core sampling apparatus" is nominally used to refer to the apparatus created when a core sampling assembly is inserted/incorporated into a drilling apparatus. But, the terms should not be interpreted restrictively and, the core sampling assembly inserted into a drilling apparatus could alternatively be referred to a core sampling apparatus by someone skilled in the art.

Figure 1D:
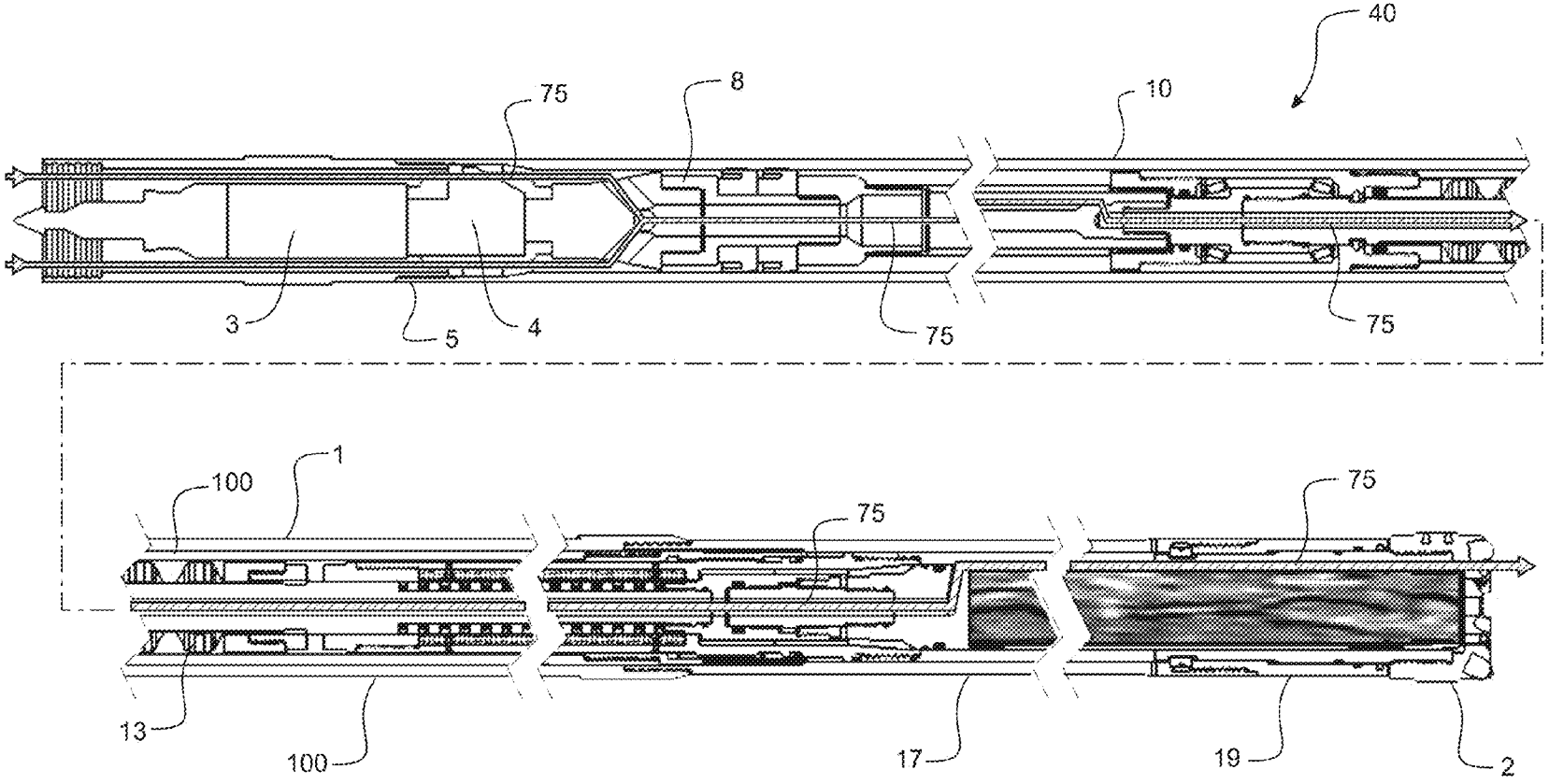

FIGS. 1A to 1C depict the same contiguous apparatus, but split into three separate drawings for purposes of magnifying details. In use, the left end of FIG. 1A connects to a drill rig and is uphole; the right hand end of FIG. 1A follows directly to the left end of FIG. 1B and the right end of FIG. 1B follows directly to the left end of FIG. 1C. The right end of FIG. 1C is downhole near the bore face (when in use). When the apparatus is in use, the left direction in the drawings is uphole, and the right direction is downhole. FIG. 1D shows the full apparatus, including drilling fluid flow 75 though the apparatus.

The apparatus is for taking core samples in a manner that protects the core sample. The drilling apparatus 40 comprises an outer drill housing 1 (also termed "drillstring" or "drill rod" or "casing") coupled to a core taking impact bit ("drill bit" or "core (taking) bit") 2 (FIG. 1C). Embodiments can use conventional impact type bits with carbide or diamond impact bits (or similar) but with the centre removed to leave a rock core intact. These bits are very durable, are not easily damaged by a change in formation or by excessive weight on bit—and in addition they only require slow rotation (typically less than 100 RPM) meaning that specialised high speed diamond core rigs are not required.

The drill housing 1 can be rotated from the surface by a drill rig (known to those skilled in the art), which in turn rotates the drill bit 2 allowing for drilling of a bore and advancement into a formation in the usual manner. The housing thus becomes or is a "rotatable tubular housing". The drill bit 2 has cutting components which cut material from the formation bore face of the bore. The drill bit 2 has an outer casing 2*a* that couples by rotationally splining 20 to the outside of the rotatable tubular housing 1 so that it is constrained to rotate with the housing 1, but also so that it can move longitudinally/axially (left and right in the Figures) relative to the rotatable housing 1 for hammer purposes. To allow for efficient hammering and advancement into the formation, and core taking, a core sampling assembly is incorporated into the rotatable housing 1 of the drilling apparatus 40 to hammer the drill bit 2, collect a core sample 19, and enable withdrawal of the core sample 19. The core sampling assembly in the drilling apparatus 40 creates a core sampling apparatus 40 as explained above for capture and retrieval of a core from a subterranean formation. The core sampling assembly is retrievable from the drilling apparatus so that the core is retrievable. The core sampling assembly comprises a hammer 100 that oscillates or otherwise shuttles (left/right in the Figures) between two longitudinal (axial) positions in the drill housing 1 to provide uphole and downhole strokes (left/right in Figures) that hammer the drill bit 2.

Figure 2:
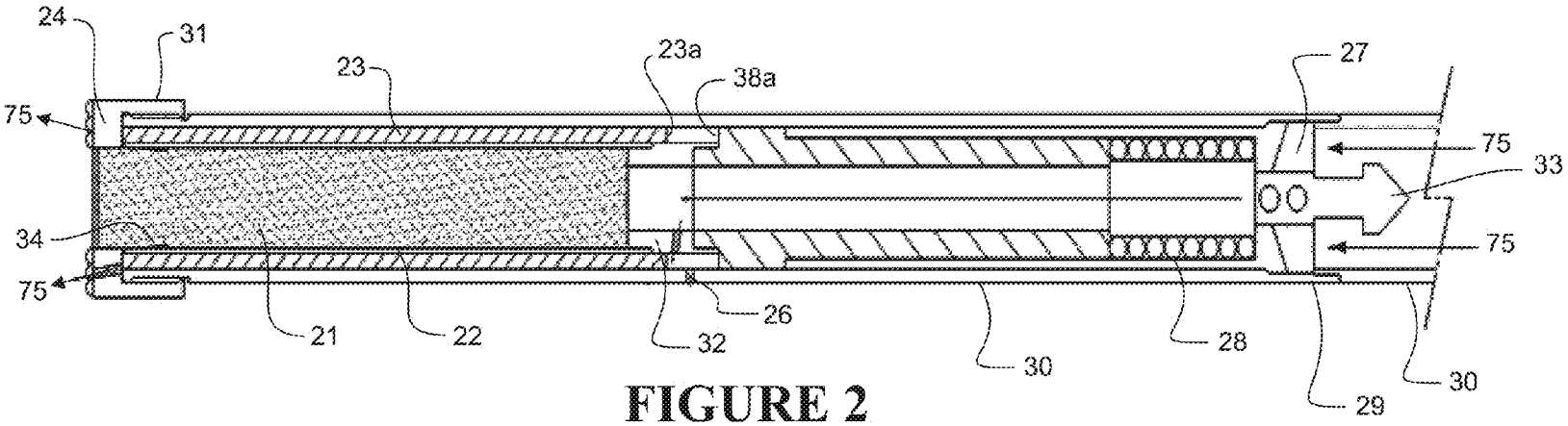
FIG. 2 showing a pneumatic or fluid hammer core sampling device according to another embodiment.
Figure 3:
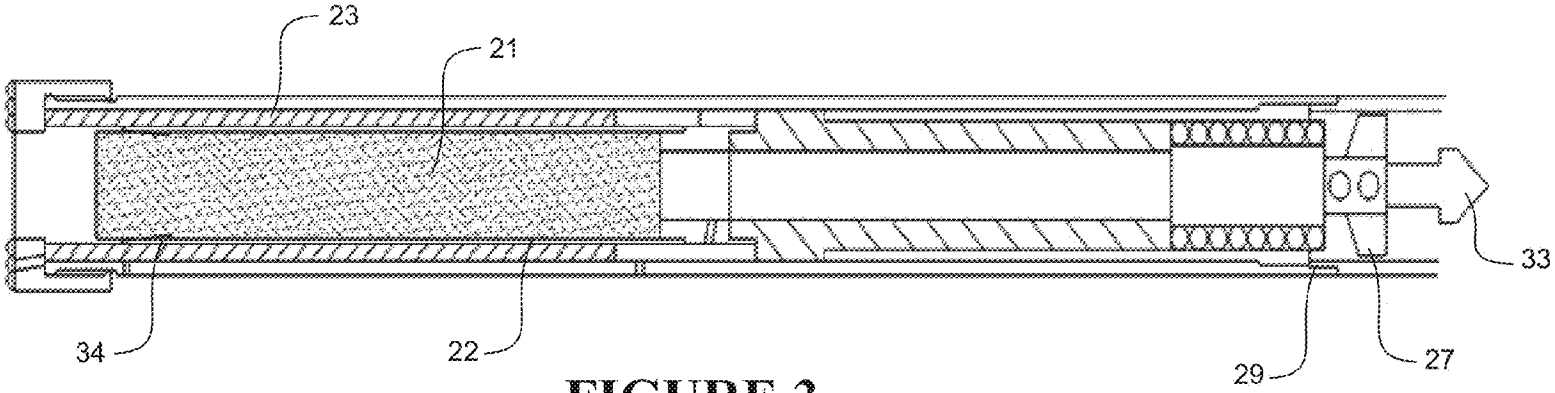
FIG. 3 showing the core sampling assembly of FIG. 2 [analogous to that of FIGS. 1A to 1C] being pulled by its retrieval overshot to the surface once the latch assembly overshot has been replaced to allow removal.

In the embodiment of FIGS. 1A to 1C, the core sampling assembly has a magnetic hammer ("shuttle") arrangement 100 and so takes the form of a magnetic hammer core sampling assembly, although other core sampling assemblies with other types of hammer arrangements could be used, such as shown air, fluid, magnetic, electromagnetic, or a mud motor (PDM) driven hammer arrangements. FIGS. 2 and 3 show another hammer arrangement.

Referring to FIGS. 1A to 1D, the (magnetic hammer) core sampling assembly comprises an overshot system 3 used to lower and retrieve the core sampling assembly (including the hammer) of the core sampling apparatus from the drilling apparatus. Below the overshot 3 system is a latch assembly 4 that couples/latches the core sampling assembly to or relative to the housing. The latch assembly 4 comprises extendible latch arms 5 (e.g. spring loaded latches) that engage with a shoulder 6 in the drill housing 1 that provides an abutment shown on the inside diameter of the drill housing 1. The latch assembly 4 constrains the magnetic hammer 100 of the apparatus (to be described below) from the upward axial movement or rebound from impacts made from the hammer 100, resulting in a focusing of all or substantially all or at least a major part of the impact force from the hammer 100 into the formation being cored.

A positive displacement motor (PDM) 8 driven by drilling mud or similar is coupled beneath the latch assembly 4. There are fluid ports 7 beneath the latch assembly 4 to allow drilling or other fluid to progress to a PDM 8, which converts hydraulic force from the fluid into mechanical rotation of a PDM output shaft 11. Pump in seals 9 are provided that can be usefully engaged in non-vertical core sampling. Thus drilling fluid can be used to pump the assembly into place and help seat the latch assembly to enable the non-vertical core samples to be obtained.

The PDM output shaft 11 extends downhole from the PDM 8 and through a bearing section provided below the PDM 8 comprising a bearing housing 10 and bearings 10*a*-10*d* that help support the rotating PDM output shaft 11. The PDM output shaft 11 is coupled at 53 to a hammer rotor input shaft 54 by a splined, threaded or other suitable coupling. (Note, the hammer rotor input shaft 54 could just be considered to be part of the output shaft 11 and the distinction of whether these are the same or different components is not critical to the invention). The hammer rotor input shaft 54 extends through the centre of a spring 13 (or other compliant component) that sits inside the rotatable tubular (drill) housing 1 with sufficient clearance so that as the shaft 54 rotates, it does not contact the spring. A first uphole end of the spring 8 is threadedly or otherwise coupled 83 to the bearing assembly 10 and a second downhole end is threadedly or otherwise coupled 80 to the magnetic hammer 100.

The spring 13 is used to cushion the uphole force from the magnetic hammer 100 as it returns to the top of its stroke during shuttling, therefore reducing stresses on the latch arms 5 and shoulder 6 of the latch assembly 4. As it is desirable to capture as large a diameter core as possible relative to the outer housing diameter, the housing 1 preferably comprises thin walled drill rods. This means that the latching assembly only has a small cross sectional abutment area to lock against. Substantial impact forces could compromise latching. As such, the spring or other compliant component helps cushion the uphole shock from hammering. Therefore, the spring 13 or other compliant component: a) reduces uphole damping, which could otherwise damage uphole components; b) helps to recapture some of the kinetic energy which is otherwise lost during shuttling; and/or c) enables a more stable shuttle oscillation. Without the spring 13, the latch arms 5 and shoulder 6 might not survive the uphole force from the hammer 100. It is not essential for operation that the spring 13 is coupled as described above (for example, it could simply bear against these components), although it is preferable as otherwise the shuttle oscillations and the spring life and fatigue are less controllable.

Figure 4:
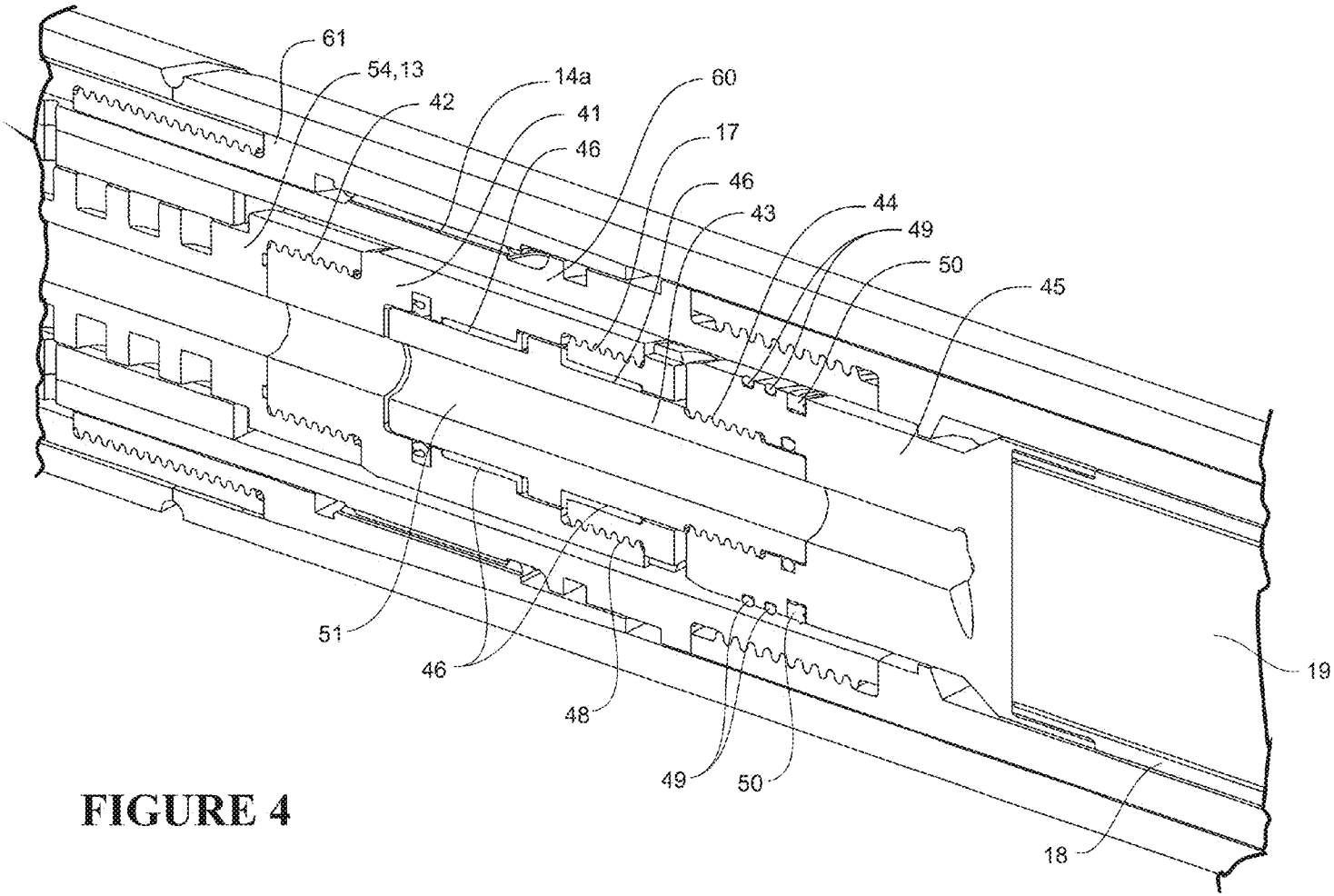
FIG. 4 showing a swivel of the apparatus/assembly as shown in FIGS. 1A-3 in more detail.

The magnetic hammer 100 is downhole from the output shaft 11 and spring 13. It has an outer hammer body 61 (see FIG. 4), inner magnetic array 15 and an outer magnetic array 14. The inner magnetic array (magnetic rotor) 15 is coupled to the hammer rotor input shaft 54. Upon rotation, the output shaft 11 via the hammer rotor input shaft 54 rotates the inner magnetic array 15 relative to the outer magnetic array 14.

The outer magnetic array does not rotate (with reference to the inner rotating magnetic array 15)—that is rotationally constrained by being splined 74 directly or indirectly to the impact transfer tube 16. Through the magnetic interaction from the relative rotation between the two magnetic arrays 14, 15, the outer magnetic array is rotationally constrained and oscillates back and forth (uphole/downhole or left/right in Figures) longitudinally/axially within the housing 1. The outer magnetic array 14 is coupled to an impact (transfer) tube 16 or other suitable structure, for example by a threaded connection 74 either directly or via a magnetic shuttle 60 (see FIG. 4). The impact transfer tube 16 sits within the outer rotatable housing 1 and has a hollow interior. The annular downhole end of the impact transfer tube 16 during operation can bear/abut/collide against the drill bit 2 within the drill bit casing 2*a*. Downhole movement of the magnetic array 14 is received by an uphole end of the impact transfer tube 16 and moves the impact transfer tube 16 downwards causing an impact/collision with the drill bit 2 through the impact transfer tube 16 at an impact zone 71, 72. The impact zone occurs where the end of the impact tube 16 hits against an "anvil" or other impact component 72 next to the drill bit 2. The drill bit 2 is splined at 20 to the drill housing 1—allowing the bit to advance axially independently of the outer rotatable housing 1 under coercion by the impact transfer tube 16, and the core sample 19 (to avoid damaging the sample being cored) into the formation with each impact.

A core catcher barrel 18 sits within the impact transfer tube (or other structure) 16 such that the impact tube or other structure surrounds the barrel 18. It has an opening downhole that sits adjacent the back of the drill bit 2 such that it is cooperable with the drill bit 2 to receive (core) material excavated by the drill bit. As the drill bit rotates and impacts the formation at the bore face, it excavates material which is captured in the core catcher barrel 18 resulting in a core sample 19. The core catcher barrel 18 is decoupled from the impact transfer tube 16 so it is independent from any longitudinal movement of the impact transfer tube 16. Keeping the core catcher barrel 18 longitudinally stationary isolates the core 19 therein from impact forces and is helpful in avoiding damaging the core sample. As such, the outer magnetic array 14 provides impact/hammering to the core taking bit 2 directly or indirectly along a longitudinal/axial impact path (through the impact tube 16 or other structure that surrounds the core catcher barrel 18) that is decoupled (or substantially decoupled) from the core so that the impact force bypasses the core. This protects the core 19.

A swivel section 17 couples the magnet hammer 100 (and in particular the rotor thereof) to the core catcher barrel 18 and core sample 19. The swivel is shown in more detail in FIG. 4. It has a swivel housing 41 that is coupled (e.g. by threaded coupling 42) to the magnetic hammer rotor 54/inner array 15, so that the housing 41 and rotor 54/inner array 15 rotate together. A rotationally isolated inner member 43 is disposed coaxially within the swivel housing 41. The inner member 43 is coupled (e.g. via threaded coupling 44) to an upper extension 45 from the core catcher barrel 18. Bearing surfaces 46 allow the swivel housing 41 to rotate independently of the inner member 43/core catcher 18/upper extension 45, and keep the inner member 43 rotationally stationary. The bearing surfaces 46 could be any suitable bearing material, such as PCM, plastic brush, or roller. The bearing surfaces 46 are retained in place by an annular plug 47 that couples (e.g. threaded coupling 48) to the swivel housing 41. O-rings 49 are provided on the core catcher barrel upper extension 45 to provide friction to assist in keeping the core catcher barrel 18 rotationally isolated. Wiper seals 50 are provided on the upper extension to keep contaminants (such as drilling fluid, etc.) out of the bearings. An internal axial cavity 51 in the inner magnetic array 15, inner member 43 and upper extensions 45 provide a pathway for drilling fluid 75, which will be explained in more detail later. An internal spline 14*a* is provided on the magnetic shuttle 60 and the internal spline mates to the outer hammer body 61 to stop the outer magnet array 14 from rotating, therefore causing axial movements.

This swivel 17 enables the core catcher barrel 18 and sample 19 to be retracted from the drilling apparatus (rotatable housing 1) upon removal of the core sampling assembly using the overshot system 3, yet still allow the core catcher barrel 18 to remain rotationally stationary (that is, rotationally decoupled from the rotor to isolate a core in the barrel from rotation forces). Keeping the core catcher barrel 18 rotationally stationary is helpful to avoid damaging the core sample. Isolating the core sample 19/core catcher barrel 18 from the rotational forces of the assembly (necessary to advance the drill bit 2) is achieved using the mechanical swivel 17. This stops the rotational action of the inner magnetic array 15 (itself rotated by the PDM output shaft 11/hammer rotor input shaft 54) from rotating the core catcher barrel 18. It can also be seen that the impact action of the impact transfer tube 16 happens around the core catcher barrel 18 (there is clearance between the core catcher barrel 18 and the impact transfer tube 16) so this does not damage the core sample.

The core drilling apparatus 40 works in the following manner. The core sampling assembly, comprising with the overshot system 3, PDM 8, spring 13, magnetic hammer 100, swivel 17, core catcher barrel 18 and impact transfer tube 16 is inserted into the rotatable housing 1 and positioned (optionally using drilling fluid) so that the impact transfer tube 16 sits against the back of the drill bit 2/anvil 72. The extendable latch arms 5 engage in the shoulder 6 to retain the apparatus in place in the drill housing 1. The drilling rig puts weight on bit and rotates the drill housing, which rotates the splined drill bit 2 to drill into the formation. Drilling fluid 75 is pumped (see FIG. 1D) into the assembly around the outside of the overshot system 3 and through the fluid ports 7 to the PDM. The fluid rotates the PDM 8 causing the PDM output shaft 11 to rotate, which, via the hammer rotor input shaft 54, turns the inner magnetic array rotor 15. The magnetic interaction between the inner magnetic array 15 and outer magnetic array 14 causes longitudinal movement in the outer magnetic array 14/shuttle 61 thus oscillating/moving/impacting the impact transfer tube 16 that is threadedly coupled 74 to the outer magnetic array 14. The downhole oscillations of/force on the impact transfer tube 16, impact (hammer) the drill bit 2 at the collision/impact zone 71/72. The weight on bit, rotation of the drill bit 2 and hammering of the drill bit 2 excavates material into the core catcher barrel 18 and advances the drill bit 2. In order for the drill bit to advance into hard formations, it has:

- weight on bit—pushed into the formation by the drill rig,
- rotation—to allow the teeth of the bit (diamond/carbide etc.) to crush/cut/grind fresh rock,
- apparatus/means to flush air/fluid etc.—for removing the cuttings, cooling the bit and minimising friction.

Referring to FIG. 1D, the drilling fluid passes through the PDM, centre of the hammer 100, through the swivel and then is diverted so that it exits/exhausts 75 to and out the bit 2 between the impact transfer tube 16 and the core catcher barrel 18. This redirects the drilling fluid away from the core sample 19 so that the drilling fluid (or air if a pneumatic hammer is used) bypasses and does not damage the core sample 19. The fluid 75 when exiting the bit 2 removes cuttings from the bore face and transfers them upwardly out of the bore around the annulus between the drill bit 2 and outer drill rod 1—as well as cooling the bit, stabilising the formation and providing lubricants to help reduce rotational torque. In summary, the redirection of the drilling fluid 75 achieves the following: delivers the required hydraulic forced to rotate the PDM 8 and energises the hammer 100; clears the drill cuttings from the bore and carries some out of the bore hole; cools the drill bit; and provides lubrication to the entire assembly. The drilling fluid 75 does not come into contact with the core sample 19—it travels to the drill bit 2 between the impact transfer tube 16 and the core catcher barrel 18.

Once a core sample 19 is captured, the overshot system 3 is operated (in a manner known to those skilled in the art) to remove core sampling assembly from the rotatable housing 1 to retrieve the core catcher barrel 18 and the core sample 19. To do this, when drilling stops, the upper end of the overshot is lowered on a wire cable inside the housing until it latches onto the top end of overshot 3 (FIG. 1*a*). The overshot 3 retracts the spring loaded arms that had engaged with abutment 6 allowing the wire cable to pull the entire assembly to the surface (all that is left down hole is the housing and drill bit).

In the embodiment above, the impact zone is shown in region 71/72. It will be appreciated that this impact zone can be at any point between the magnetic hammer 100 and the drill bit 2. For example, and as will be demonstrated with reference to FIG. 2 below, it may be desirable that the hammer 100 is not coupled to the impact transfer tube 16 at all, but rather there is an impact and corresponding impact zone between the hammer 100 and the impact transfer tube 16 to reduce the overall mass of the hammer 100. This enables higher frequency hammering. In this case, there would be no threaded connection at any point between the hammer 100 and the impact transfer tube 16 so that the impact transfer tube is a simple floating assembly that does not oscillate with the hammer 100. Rather, it would, as it is impacted at the uphole end by the hammer 100, be propelled downward and impact the drill bit 2 to transfer impact force.

As mentioned above, in alternative embodiments, the core sampling apparatus could utilise other hammer types such as pneumatic or fluid hammers, using pressurised fluid or compressed air to energise the hammer assembly could replace the magnetic hammer section 100 to allow successful core sampling. The choice of the hammer itself is not so important, as various hammer mechanisms have been used for many years and a detailed explanation of how they work is not warranted.

Irrespective of the type of hammer arrangement used, preferably a core sampling apparatus/assembly according to the invention is one that has the attributes 1-6 listed below.

1. The core sample is protected from mechanical damage (both impact and rotary) the core is housed within the core catcher assembly, which is isolated from the impact transfer tube.
2. The drilling fluid (if used) energises the hammer and then exhausts between the core barrel or catcher and the impact transfer tube and exits at the bit—some fluid is allowed to escape the hammer at the impact zone to help reduce the fluid damping the impact force.
3. The hammer is held in place during impact by a latch assembly, the spring allows the latch assembly and shoulder (small cross sectional abutment) to survive during impact and reduces the stress on the outer housing.
4. The drill bit is splined to the outer housing, allowing the impact force to be transferred from the hammer to the formation—without damaging the outer housing.
5. The rotary swivel assembly allows the captured core to be kept rotationally static.
6. The hammer assembly and core are pulled to surface by a wire latching mechanism which attaches to the overshot. Once the core is removed at surface the hammer and core catcher assembly is again lowered down hole.

FIGS. 2 and 3 show an alternative embodiment of a core sampling apparatus/assembly that utilises a different type of hammer 38, in this case a hydraulic hammer. The core sampling assembly is incorporated into a drill housing 1, such as previously described in relation to FIG. 1 although details will be briefly described again. The core sampling assembly comprises an overshot system 33 that is coupled to a latch assembly 27, and the latch assembly has extendable arms that are coupled to a shoulder 29 in the housing 1. A spring 28 is provided that bears against the latch assembly 27 and a hydraulic hammer arrangement 38. The hammer arrangement 38 has shoulders 38*a* that correspond to the uphole annular surface 23*a* of a hollow impact transfer tube 23. A core catcher barrel 22 sits inside the impact transfer tube 23 in a rotational and slidably independent/isolated/decoupled manner. The downhole open end of the core catcher barrel 22 sits behind the drill bit 24 to capture core material that is excavated by the drill bit 24. The drill bit 24 is coupled to the drill housing 1 and rotationally splined in a manner as described in relation to the embodiment of FIG. 1. The downhole annular surface 23*b* of the impact transfer tube bears/abuts/collides against the inside of the drill bit 24.

In operation, the core sampling assembly, comprising the overshot system 33, hammer 38, core catcher barrel 22 and impact transfer tube 23 is inserted into the rotatable housing 1 and positioned so that the impact transfer tube 23 sits against the back of the drill bit 24. The extendable latch arms engage in the shoulder 29 to retain the apparatus in place in the housing 1. The drilling rig puts weight on bit and rotates the housing 1, which rotates the splined drill bit 2 to drill into the formation at the bore face. Drilling fluid 75 energises the hammer 38 with its hammer mass to coerce the hammer mass towards the impact transfer tube 23. The shoulders on the hammer 38*a* impact against the uphole annular surface 23*a* of the impact transfer tube 23 at an impact zone. This causes the impact transfer tube 23 to impact against the drill bit 24. The weight on bit, rotation of the drill bit 24 and hammering of the drill bit 2 excavates material into the core catcher barrel 22 and advances the drill bit 2.

During operation, drilling fluid exhausts 75 between the core catcher 22 and the impact transfer tube 23 and exits at 25 from the bit 24. Some fluid is also allowed to escape at 26 in the hammer impact zone to help reduce the fluid damping the impact force.

The hammer is held in place during impact by the latch assembly 27. The spring 28 allows the latch assembly 27 and shoulder 29 (small cross sectional abutment) to survive and reduces the stress on the drill rod 30 above the latch assembly.

In FIG. 2 the core sample 21 is protected from mechanical damage (both impact and rotary). The core 21 is housed within the core catcher assembly 22, which is isolated from the impact transfer tube 23.

The drill bit 24 is splined at 31 to the drill housing 30, allowing the impact force to be transferred via impact transfer tube 23 from the hammer mass via the bit 24 to the formation—without damaging the drill housing 30. The rotary swivel joint 32 allows the captured core 21 to be rotationally static.

Once a core sample is captured, the overshot system 3 is operated to remove core sampling assembly from the drill housing 1 to retrieve the core catcher barrel and the core sample. As shown by FIG. 3, the hammer assembly and core 21 (retained in the core catcher i.e. barrel 22 with retention features 34) are pulled to surface by a wire latching mechanism which is attached to the overshot 33. Once the core is removed at the surface the hammer and core catcher assembly is again lowered down hole.

What I claim is:

1. A core sampling apparatus to allow the capture and retrieval of a core from a subterranean formation, the apparatus comprising or including:

a rotatable tubular housing, a core taking bit constrained to rotate with the housing yet able to move axially with respect to the rotatable tubular housing, a retrievable core sampling assembly latchable to or relative to the rotatably tubular housing comprising:

a core catcher barrel for a core, the barrel being rotationally isolated from the tubular housing and cooperable with the core taking bit to retain a core, and a hammer for providing impact to the core taking bit along a longitudinal impact path that is or is substantially decoupled from the core catcher barrel, wherein the tubular housing is operable to rotate the bit and the hammer is operable to impact the bit to capture and pass core material from the formation to the core catcher barrel in a manner that isolates a core in the core catcher barrel from rotation and impact forces.

2. The core sampling apparatus according to claim 1 wherein the longitudinal impact path comprises an impact tube or structure surrounding the core catcher barrel that receives impact from the hammer at a first end and bears against the core taking bit at another end to transfer the impact.

3. The core sampling apparatus according to claim 1 wherein the core taking bit is splined to the rotatable tubular housing to rotationally constrain the core taking bit yet enable it to move axially, and upon receiving an impact, the core taking bit moves axially with respect to the rotatable tubular housing.

4. The core sampling apparatus according to claim 1 wherein the retrievable core sampling assembly is latchable to or relative to the rotatable tubular housing using a latching assembly that latches the assembly to or relative to the rotatably tubular housing.

5. The core sampling apparatus according to claim 4 further comprising a compliant member between the latching assembly and the hammer to hold the hammer directly or indirectly on the bit, yet during hammer operation restrict stress on the latching assembly to maintain latching of the assembly to or relative to the rotatable tubular housing.

6. The core sampling apparatus according to claim 1 wherein the hammer is actuated by drilling fluid, wherein the drilling fluid exhausts between the core catcher barrel and impact tube or structure that surrounds the core catcher barrel and through the core taking bit thus bypassing a core in the core catcher barrel.

7. The core sampling apparatus according to claim 1 wherein the hammer comprises a rotor that upon rotation generates longitudinal movement in an impact member that provides the impact to the core taking bit, wherein the rotor is coupled via a swivel joint to the core catcher barrel so that the barrel can be retracted yet is rotationally decoupled from the rotor to isolate a core in the catcher barrel from rotation forces.

8. The core sampling apparatus according to claim 7 wherein the hammer is a magnetic hammer, and the rotor is an inner magnetic array that rotates relative to an outer magnetic array that is the impact member, wherein the inner magnetic array is coupled via the swivel joint to the core catcher barrel so that the barrel can be retracted yet is rotationally decoupled from the rotor to isolate a core in the catcher barrel from rotation forces.

9. The core sampling apparatus according to claim 1 wherein the latching assembly, compliant member, hammer, and core catcher barrel of the core sampling assembly are coupled so that they can be inserted into the rotatable tubular housing and latched to or relative to the rotatable tubular housing and retrieved from the rotatable tubular housing by delatching the latching assembly and removing the core sampling assembly using a wire latch.

10. A method of obtaining a core sample comprising using an apparatus/assembly of claim 1 and operating the apparatus/assembly to rotate and hammer a bit in a manner to isolate the core from rotation and impact forces.

* * * * *